United States Patent [19]

Lee et al.

[11] Patent Number: 4,819,942

[45] Date of Patent: Apr. 11, 1989

[54] GOLF SWING INDICATOR

[75] Inventors: Sung Y. Lee, Aiea; Lloyd Nakama, Waimanalo, both of Hi.

[73] Assignee: Swinglite, Inc., Aiea, Hi.

[21] Appl. No.: 104,978

[22] Filed: Oct. 6, 1987

[51] Int. Cl.[4] ..... A63B 69/36

[52] U.S. Cl. ..... 273/186 A; 273/183 E; 273/194 R; 273/35 A

[58] Field of Search ..... 273/186 R, 186 A, 194 R, 273/186 C, 186 D, 194 A, 183 E, 35 A

[56] References Cited

U.S. PATENT DOCUMENTS

| | | | |
|---|---|---|---|
| 2,158,211 | 5/1939 | Aitken | 273/186 A |
| 3,191,939 | 6/1965 | Hooper | 273/186 A |
| 3,753,564 | 8/1973 | Brandell | 273/186 A |
| 3,820,795 | 6/1974 | Taylor | 273/186 A |
| 3,863,933 | 2/1975 | Tredway | 273/186 A |
| 3,953,034 | 4/1976 | Nelson | 273/186 C |
| 4,108,441 | 8/1978 | Tredway | 273/186 A |
| 4,342,456 | 8/1982 | Miyamae | 273/186 A |
| 4,456,257 | 6/1984 | Perkins | 273/186 R |

*Primary Examiner*—George J. Marlo

*Attorney, Agent, or Firm*—Dennison, Meserole, Pollack & Scheiner

[57] ABSTRACT

A golf swing indicator including a toroidal housing frictionally receivable on a split elastomeric sleeve surrounding a golf club hosel. A battery powered internal light source is controlled by a centrifugal switch to illuminate upon swinging of the club with the illumination being upwardly directed by a back reflector behind the bulb and through an overlying multifaceted lens-type wall. The housing is invertible to upwardly expose the reflector through a second transparent wall for reception and reflection of ambient light.

17 Claims, 2 Drawing Sheets

GOLF SWING INDICATOR

BACKGROUND OF THE INVENTION

Training devices for use by both novice and experienced golfers take many forms and involve substantially every aspect of the game. The particular area of concern of the present invention is the golf swing, that is the swing of the golf club and the path taken by the club head.

Devices of this general type are known as evidenced by the following patents:

U.S. Pat. Nos. 3,820,795, Taylor, June 28, 1974,
3,863,933, Tredway, Feb. 4, 1975,
3,953,034, Nelson, Apr. 27, 1976,
4,108,441, Tredway, Sr., Aug. 22, 1978.

In each of these patents, a light pattern is defined and visible to the club user for a determination of the path of the club swing. In Taylor, the light generating device is a standard minature flashlight mounted along the forward face of the club hosel by a resilient member which engages about the hosel. The flashlight, upon a manual turning on of the light, shines up toward the user of the club. The remainder of the patents project light on adjacent surfaces.

The known club-mounted devices, in addition to requiring separate manual actuation of a switch or the like to provide the desired light, either necessitate a modification of the club head or mount on the shaft in a manner which inherently affects the balance thereof.

SUMMARY OF THE INVENTION

The swing indicator of the present invention requires no modification of the club and mounts on the hosel of the club in a manner which maintains the club balance so as to have little or no effect on the swing.

Further, the swing indicator, while utilizing internal illumination, does so in a manner whereby the internal illumination is provided only when the club is actually being swung, thus both preserving the batteries and bulb thereof, and avoiding the distraction of a constantly lit bulb.

In addition to the internal illumination which particularly adapts the indicator for low light conditions, the indicator also is adapted to utilize external light, for example natural sunlight, to define a luminous appearance independently of internal illumination.

The indicator is invertible between a low light or night position wherein reliance is on the internal illumination, and a daylight position wherein external illumination is used.

The indicator of the invention comprises a rigid plastic housing of general toroidal shape slidable over a club shaft in surrounding relation thereto and releasably mounted to the club hosel by an elongate tubular elastomeric mounting sleeve. The mounting sleeve includes a tapered exterior for a frictional locking of the housing thereto, the sleeve in turn being frictionally clamped to the hosel.

The housing, in the low light position, is defined by upper and lower annular sections releasably snap locked together to define an internal annular chamber. The upper section is preferably red and transparent or transluscent. The illumination components are mounted in the lower section and comprise a pair of generally diametrically opposed batteries within appropriate mounts, a light bulb electrically wired between common first ends of the batteries, and a centrifugal switch arrangement between second common ends of the batteries generally diametrically opposed from the light bulb. An appropriate reflector, provided with opposed highly reflective surfaces, underlies the bulb and extends along an arc of the annular chamber for an upward reflecting and amplification of light generated by the bulb. The upper section of the housing has a multifaceted inner surface on at least the upper wall thereof to both diffuse and transmit the internally generated light, preferably spreading the light, through the curved nature of the plastic material, completely about the annulus. The multifacets will be in the nature of small pyramids for reflecting the generated light to define a distinctly visible exterior surface.

The lower section of the housing is transparent at least about an arc coextensive with the arc of the reflector underlying the bulb. Thus, upon an inverting of the indicator, the reflector is upwardly exposed to present an arcuate transversely bowed highly reflective surface toward the user for receiving and reflecting external light, such as sunlight. In this inverted or daylight position, the reflector will be aligned over the club head.

In use, the indicator mounts on a club hosel in equally balanced surrounding relation thereto so as to have little or no effect the club balance. The device, constructed of an appropriate synthetic resin or plastic, is of minimal weight with such weight being uniformly distributed. In the night position, the light-transmitting upper surface of the indicator faces upwardly toward the club user with the centrifugal switch positioned to provide an automatic illumination of the interior light bulb upon a swinging of the club. Inasmuch as the indicator is to be used as a teaching aide, there will be many periods of both use and non-use. Under such circumstances, the incorporation of a centrifugal switch provides for maximum conservation of the batteries and an illumination of the light bulb only at such times as it is actually used and by the normal expedient of swinging the club. No extra effort or manipulative step is required to either turn on the bulb or turn off the bulb.

In the inverted or daylight position, the indicator will reflect external light, such as for example bright sunlight, with the highly reflective nature of the reflector surface greatly enhancing the visability of the indicator, making internal illumination unnecessary. Thus, the centrifugal switch is positioned to remain open when mounted in its inverted position.

The indicator is primarily intended for use as a device which enables the golfer to visibly note the club head path as the club is swung to allow for self-monitoring, corrections or adjustments in the swing.

The clear visual outline of the swing path provided by the illuminated indicator enables the golfer to readily detect his habitual swing path, and based thereon make such modifications as he may desire to change or correct the flight path of the ball. The indicator is particularly useful in assisting the golfer to properly achieve outside-in and inside-out swing paths and such modifications as to achieve substantially any desired result such as straight, draw and fade shots.

Other objects and advantages of the invention reside in the details of construction and manner of use of the indicator as more fully hereinafter described and claimed.

DESCRIPTION OF PREFERRED EMBODIMENT

Figure 1:
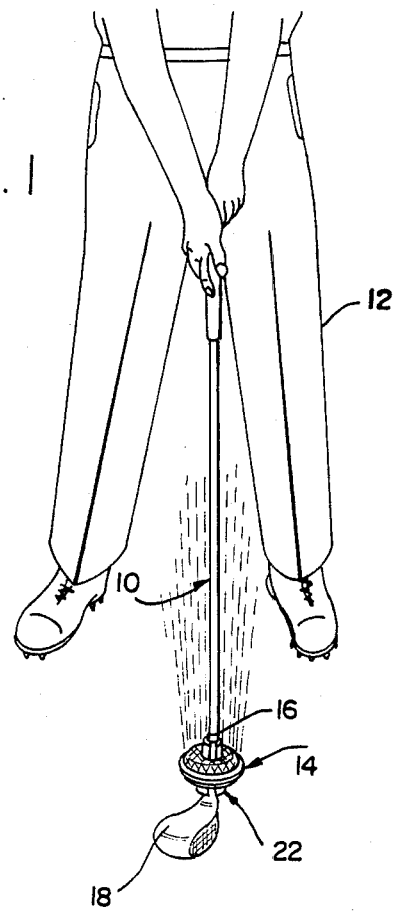
FIG. 1 illustrates a golfer-held club with the indicator of the invention mounted thereon for use under low-light conditions.

Referring now more specifically to the drawings, FIG. 1 illustrates a conventional golf club 10 held by a golfer 12 in preparation for a swinging thereof. The club 10 has the indicator 14 of the invention in the low-light or night position frictionally mounted on the housel 16 in surrounding relation thereto and sufficiently above the club head 18 to maintain the head readily visible.

The indicator 14 includes a generally toroidal or annular housing 20 formed of an appropriate rigid synthetic resin, and an elongate resiliently compressible tubular mount or mounting sleeve 22. The sleeve 22 includes a full length longitudinal slit or slot 24 therein, a constant diameter internal passage 26 and an exterior surface defining a frusto-conical configuration tapering from an upper end 28 of lesser diameter to a lower end 30 of greater diameter.

The internal bore 26 of the mounting sleeve 22 is of lesser diameter than the tapered hosel 16 of the club 10. The sleeve 22 is engaged about the hosel 16 by an outward flexing of the sleeve at the longitudinal slot 24 to allow for the sleeve to be laterally introduced about the club shaft or hosel itself. Once introduced about the shaft or hosel, the sleeve 22 is downwardly slid into proper location on the hosel and, through the inherent flexible resiliency of the sleeve 22, frictionally fixed in position preparatory to receiving the indicator housing 20.

The toroidal housing 20 includes an inner and an outer periphery with the inner periphery defining a club-receiving central passage 32 through the housing 20. The diameter of the central passage 32 is such as to receive the lesser diameter upper end portion of the hosel-mounted sleeve 22 therethrough with the progressively increasing diameter of the sleeve 22 increasing beyond the diameter of central passage 32 for a progressively increasing frictioal engagement of the housing with the sleeve as the elastomeric sleeve is compressed by the rigid housing. This compression of the sleeve further enhances the frictional engagement of the sleeve with the hosel, thus providing for a positive fixing of the indicator 14 to the hosel 16. It will also be appreciated that as the fixing of the housing to the hosel involves a downward movement of the housing on the hosel, with the mounting sleeve 22 therebetween, the natural swinging movement of the club will continually encourage or enhance this frictional engagement through the tendency for the housing 22 to move outward toward the club head.

The housing 20, assuming the night position of FIGS. 3–6, includes upper and lower annular sections 34 and 36. The upper section 34 includes an upper wall 38, a depending inner peripheral wall 40 and an outer peripheral wall 42. The outer wall 42 which extends integrally and arcuately from the top wall 38, terminates in an annular inwardly directed locking lip 44 and an outwardly directed flange 46.

The lower annular housing section 36 includes a bottom wall 48, an upwardly extending inner peripheral wall 50 which combines with the inner peripheral wall 40 of the upper section 34 to define a smooth bore forming the central passage 32, and an outer peripheral wall 52 defined as an arcuate continuation of the bottom wall 48. The outer peripheral wall 52 terminates, at the upper annular edge thereof, in an outwardly directed undercut lip 54 which snap locks with the inwardly directed annular lip 44 of the upper section to releasably lock the sections together. The inherent flexibility of the plastic material of the upper and lower annular sections 34 and 36 and the shape thereof, allow for a snap locking of the sections together as well as a forceable disengagement of the sections as required for internal servicing of the indicator. The lower housing section 36, similar to the upper section 34, also includes an outwardly directed annular flange 56.

The means for illuminating the indicator 14 is mounted within the lower section and includes a pair of batteries 58 mounted at diametrically opposed positions in the groove or channel of the lower section. 1.5 volt, size "N" batteries have been found particularly adaptable for providing the necessary electrical energy while being of a compact size for incorporation into the indicator housing 20 in opposed balanced positions. Each of the batteries mounts between a pair of pedestals or posts 60 fixed within the housing groove and in turn mounting appropriate contact plates 62. A light bulb 64 is positioned within the channel beween the batteries at one end thereof with electrical conducting wires 66 engaged between the battery contact panels and the bulb. The bulb 64 is of a size whereby the wires 66 themselves constitute the bulb mount.

A switch assembly 68 is provided between ends of the batteries 58 and includes a contact-defining switch plate 70 extending laterally from one of the contact panels 62 associated with the second ends of the batteries, and an elongate resiliently flexible metal switch arm 72 secured at one end thereof to the corresponding contact panel 62 of the other battery 58 and extending therefrom into spaced overlying relation to the switch plate 70. The switch arm 72 and switch plate 70 combine to define a centrifugal switch whereby upon an appropriate movement of the indicator, through a swinging of the club 10 in a conventional manner, the free end of the switch arm 72 engages the switch plate 70 and closes the circuit to light the bulb 64. The flexibility of the metal switch arm 72, which may include a contact-metal weight on the free end thereof, is such as to ensure centrifugal closure of the switch throughout the full range of movement of the indicator in the low-light or night position as the club is swung in a normal manner. In all instances wherein the club is at rest, the switch arm is disengaged from the switch plate and the circuit open, thus effectively conserving both the battery and the bulb without requiring repeated manual manipulation of a switch.

Figure 5:
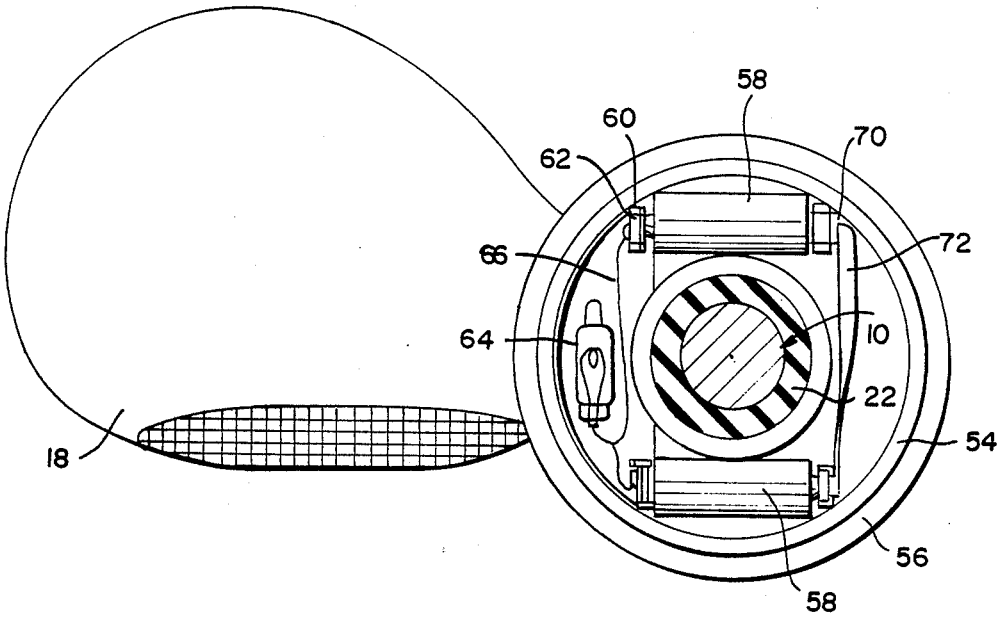
FIG. 5 is a plan view of the club-mounted indicator of FIG. 1 with the upper section removed.
Figure 6:
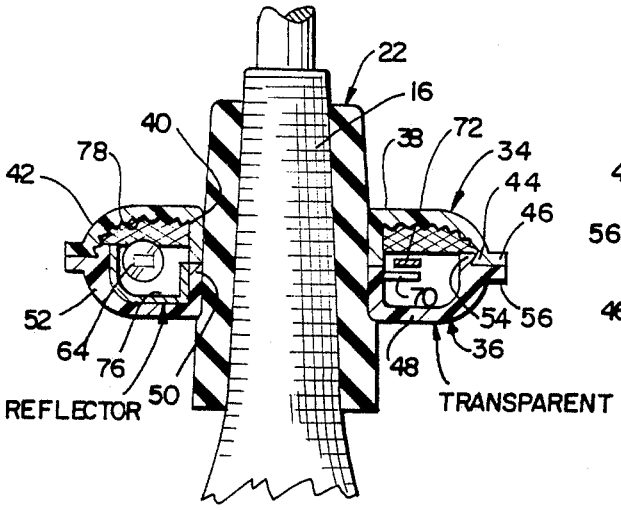
FIG. 6 is an enlarged cross-sectional view through the club mounted indicator of FIG. 1; and, FIG. 7 is an enlarged cross-sectional view through the club-mounted indicator of FIG. 2.

As will be noted in FIG. 5, the switch arm can consist of a single length metal strip having a smooth curvature to position the opposed ends at approximately rights angles to each other with the free end horizontally overlying the switch plate 70 in space relation thereto and the second end in fixed electrically transmitting engagement with the opposed vertical contact panel.

In order to enhance the light transmitting capability of the bulb 64, the channel or groove, along an extended arc beneath and laterally about the bulb, is provided with an elongate opaque reflector 76 with opposed silvered or highly reflective surfaces for an upward directing of all of the bulb-emitted light rays toward the top wall 38 of the upper housing section 34.

The upper section 34, preferably in its entirety, comprises a colored lens, for example red with the inner surface thereof having multiple pyramidal projections 78 or otherwise being multifaceted to both transmit and diffuse the interiorly generated artificial light about at least a major portion of the upper section 34. The formed pyramids 78 will preferably be ⅛" in height and ⅛" on each side of the base. The annular nature of this upper section and the generally arcuate configuration of the outer peripheral wall 42 will also tend to peripherally channel the light rays outward from the bulb 64. The bulb 64 for maximum illumination will normally be aligned with the front of the shaft and the club head 18. With the internal illumination, it will be appreciated that the indicator is effective under a wide range of ambient low-light conditions with the relative illumination increasing as the ambient light decreases.

Figure 2:
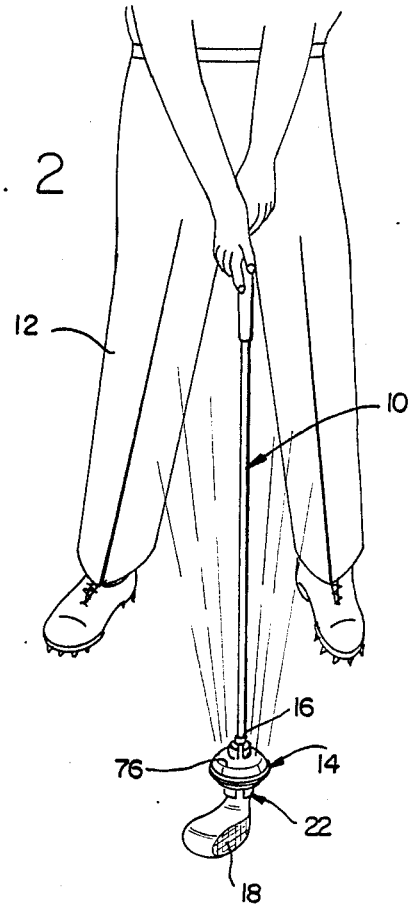
FIG. 2 is a view similar to FIG. 1 with the indicator inverted to its daylight position.
Figure 3:
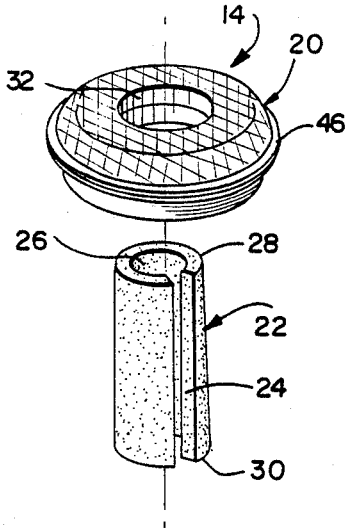
FIG. 3 is an exploded perspective view of the indicator housing and mounting sleeve.
Figure 4:
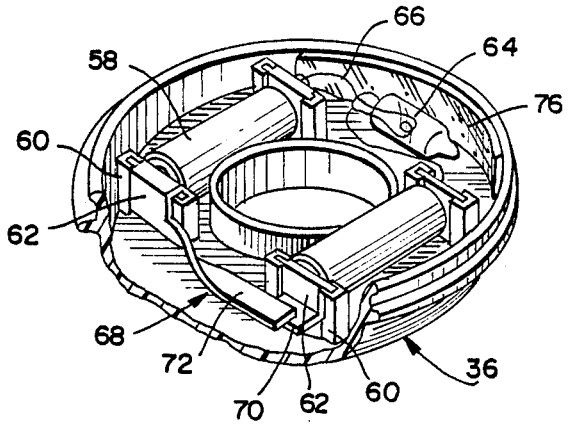
FIG. 4 is a perspective view of the interior of the lower section of the housing with the illumination components therein.
Figure 7:
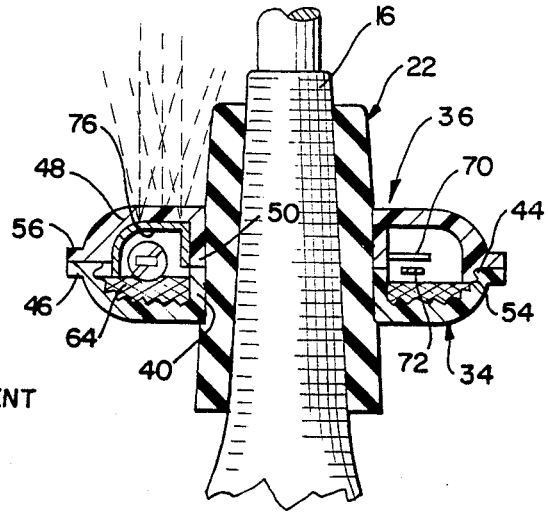

For use under conditions of bright or high ambient light, for example sunlight, wherein the internal illumination is not required, the indicator 14 is inverted as in FIG. 2 and 7. In this position the centrifugal switch is also inverted and under normal swinging of the club will not close.

When so oriented, the reflector 76 is upwardly directed and aligned with the front of the club shaft and the club head. The housing section 36, which is now the uppermost section, will be transparent either in its entirety or at least about an arc corresponding to and fully exposing the reflector 76. Thus, the highly reflective upwardly directed surface of the reflector 76 is exposed to ambient light rays and will effectively reflect these rays upward toward the user. The arcuate nature of the reflector 76, both longitudinally and transversely, will enhance the reception and reflection of the rays and provide a highly visible illuminated arc without requiring use of the internal light source.

The indicator as described is unique in its annular balanced construction and its adaptability, through an inverting thereof, to accommodate both low-light conditions and bright ambient light conditions. The symetrical construction of the housing allows a mounting of the indicator in each of its two positions with equal facility. The centrifugal switch is operable in the low-light position of the indicator and closes to light the bulb only under actual use conditions, that is a swinging of the club. All of the operating components, including the switch, bulb and batteries are mounted within the annular housing. The housing itself in one position presents a light diffusing lens to the user, and in the second position exposes a light reflecting surface to the user.

What is claimed:

1. A golf swing indicator mountable on a golf club in surrounding relation to the hosel thereof; said indicator including a housing of a generally toroidal configuration with an inner annular periphery and an outer annular periphery, said inner annular periphery defining a central passage through said housing, a source of artificial light within said housing, said housing including an upper wall of light transmitting material for transmitting artificial light from said source, a lower wall, and means for illuminating said source in response to movement of the indicator in conjunction with swinging of an indicator-mounting club, said means for illuminating said source of artificial light being completely contained within said housing and includes battery means, conductor means forming an electrical circuit with said battery means and said artificial light source, and a normally open switch in said circuit, said switch closing in response to and during swinging movement of the indicator.

2. The golf swing indicator of claim 1 wherein said lower wall is transparent and light reflector means immediately inward of said lower wall for reflecting externally originating light.

3. The golf swing indicator of claim 2 including mounting means for mounting the housing on the hosel of a golf club, said mounting means comprising a resiliently compressible elongate tubular mount receivable about the hosel of a golf club, the inner annular periphery of said housing receiving said tubular mount for frictional fixing of said housing to said mount and said mount to the hosel of a golf club.

4. The golf swing indicator of claim 3 wherein said tubular mount is longitudinally split for facilitating engagement about a club hosel, said mount having upper and lower ends and an exterior tapered from a lesser diameter at said upper end to a greater diameter at said lower end, said lesser diameter upper end being freely received within the inner annular periphery of said housing, said greater diameter lower end being of greater cross-sectional area than said inner annular periphery of said housing and precluding passage of said housing thereover.

5. The golf swing indicator of claim 4 wherein said housing includes releasably interlocked upper and lower annular sections, each of said sections including an annular inwardly directed groove defined by the corresponding upper or lower wall, an inner periphery wall, and an outer periphery wall.

6. The golf swing indicator of claim 5 wherein said conductor means includes two pairs of spaced battery contacts mounted to diametrical opposed sides of the central passage, said battery means comprising a pair of batteries, one mounted between the battery contacts of each pair of contacts for positioning in generally balanced relation to opposite sides of a club hosel received through said central passage.

7. The golf swing indicator of claim 6 wherein said artificial light source comprises a light bulb, said light bulb and said switch being mounted to generally diametrically opposed sides of the central passage generally transverse to said batteries.

8. The golf swing indicator of claim 1 wherein said conductor means includes two pairs of spaced battery contacts mounted to diametrical opposed sides of the central passage, said battery means comprising a pair of batteries, one mounted between the battery contacts of each pair of contacts for positioning in generally balanced relation to opposite sides of a club hosel received through said central passage.

9. The golf swing indicator of claim 8 wherein said artificial light source comprises a light bulb, said light bulb and said switch being mounted to generally diametrically opposed sides of the central passage generally transverse to said batteries.

10. A golf swing indicator mountable on a golf club in surrounding relation to the hosel thereof; said indicator including a housing with a central passage therethrough, a source of artificial light within said housing, said housing including an upper wall of light transmitting material for transmitting artificial light from said source, a lower wall, said lower wall being transparent, means for illuminating said source in response to movement of the indicator in conjunction with swinging of an indicator-mounting club, and light reflector means immediately inward of said lower wall for reflecting externally originating light.

11. The golf swing indicator of claim 10 wherein said reflector means underlies said light source and includes a first reflective surface facing said light source and said upper wall, and a second reflective surface facing said lower wall.

12. The golf swing indicator of claim 11 wherein said housing is of a generally toroidal configuration with an inner annular periphery and an outer annular periphery.

13. The golf swing indicator of claim 12 including mounting means for mounting the housing on the hosel of a golf club, said mounting means comprising a resiliently compressible elongate tubular mount receivable about the hosel of a golf club, the inner annular periphery of said housing receiving said tubular mount for frictional fixing of said housing to said mount and said mount to the hosel of a golf club.

14. The golf swing indicator of claim 13 wherein said housing is reversible for a selective positioning of said lower wall on top with the reflector overlying the light source.

15. A golf swing indicator mountable on a golf club in surrounding relation to the hosel thereof; said indicator including a housing of generally toroidal configuration with an inner periphery and an outer periphery, said inner periphery defining a central passage for reception of the club hosel therethrough, said housing including spaced opposed annular walls extending between said inner and outer peripheries, means for transmitting light outwardly from at least one of said walls, said housing being invertible and receivable on a club hosel to alternately position each of said annular walls uppermost, and mounting means for mounting the housing on the hosel of a golf club, said mounting means comprising a resiliently compressible elongate tubular mount receivable about the hosel of a golf club, the inner periphery of said housing receiving said tubular mount for frictional fixing of said housing to said mount and said mount to the hosel of a golf club, said tubular mount being longitudinally split for facilitating engagement about a club hosel, said mount having upper and lower ends and an exterior tapered from a lesser diameter at said upper end to a greater diameter at said lower end, said lesser diameter upper end being freely received within the central passage of said housing, said greater diameter lower end being of greater cross-sectional area than said central passage and precluding passage of said housing thereover.

16. A golf swing indicator mountable on a golf club in surrounding relation to the hosel thereof; said indicator including a housing of generally toroidal configuration with an inner periphery and an outer periphery, said inner periphery defining a central passage for reception of the club hosel therethrough, said housing including spaced opposed annular walls extending between said inner and outer peripheries, said housing being invertible and receivable on a club hosel to alternately position each of said annular walls uppermost, means for transmitting light outwardly from at least one of said walls, said means for transmitting light comprising an internal light source within said housing directed toward a first one of said annular walls, means responsive to swinging movement of the indicator to illuminate said light source, and a light reflector within said housing between said light source and the second of said annular walls, said reflector reflecting ambient light entering through said second annular wall outward through said second annular wall, said reflector reflecting light from said light source outward through the first annular wall.

17. A golf swing indicator mountable on a golf club in surrounding relation to the hosel thereof; said indicator including a housing of generally toroidal configuration with an inner periphery and an outer periphery, said inner periphery defining a central passage for reception of the club hosel therethrough, said housing including spaced opposed annular walls extending between said inner and outer peripheries, said housing being invertible and receivable on a club hosel to alternately position each of said annular walls uppermost, and means for transmitting light outward from at least one of said walls, said means for transmitting light comprising a light reflector within said housing in underlying relation to one of said annular walls, said reflector receiving ambient light entering through said one annular wall and reflecting said light outward through said one annular wall.

* * * * *